United States Patent [19]

George

[11] Patent Number: 4,798,031

[45] Date of Patent: Jan. 17, 1989

[54] DOUBLE POLE SPANNER DISPLAY

[75] Inventor: Gary P. George, St. Louis, Mo.

[73] Assignee: Stout Industries, Inc., St. Louis, Mo.

[21] Appl. No.: 115,990

[22] Filed: Nov. 2, 1987

[51] Int. Cl.[4] ..... E04C 1/00

[52] U.S. Cl. ..... 52/309.11; 40/607

[58] Field of Search ..... 52/309.9, 309.11; 160/201, 232; 40/607, 606, 611

[56] References Cited

U.S. PATENT DOCUMENTS

| | | | |
|---|---|---|---|
| 1,643,585 | 9/1927 | Pitou | 40/606 |
| 2,926,727 | 3/1960 | Purdy | 160/232 |
| 3,478,135 | 11/1969 | Randall | 52/309.9 |
| 3,786,609 | 1/1974 | Difazio | 52/309.9 |
| 3,967,671 | 7/1976 | Stanley | 160/201 |
| 4,040,194 | 8/1977 | Penton | 40/607 |
| 4,379,480 | 4/1983 | Kempel | 52/309.9 |

OTHER PUBLICATIONS

*Reinhold Plastics Applications Series Polyurethanes*, by Bernard A. Dombrow, (pp. 62–67).

*Primary Examiner*—Henry E. Raduazo

*Attorney, Agent, or Firm*—Kalish & Gilster

[57] ABSTRACT

A wind-resistant elongated spanner includes a display member to be supported longitudinally at opposite ends in the space between opposed extrinsic portal-defining upright structures, such as canopy poles, in display configuration. It has a thin beam configuration core presenting parallel, rectangular front and rear faces having a high aspect ratio. Channel configuration top and bottom rails extend along top and bottom core faces. Metal face panels extend over the front and rear core faces, layers of adhesive being interposed between the face panels and respective front and rear core faces for securement of the faces panels to the core, opposite end faces of the core being uncovered. The display member is supported by mounting members at opposite ends of the display member, each configured for attachment to a pole or other upright structure to provide a channel opening toward the display member for reception of marginal portions of an end of same.

7 Claims, 1 Drawing Sheet

DOUBLE POLE SPANNER DISPLAY

BACKGROUND AND SUMMARY OF THE INVENTION

This invention relates to signs and, more particularly, to a so-called double pole spanner to provide a display supported longitudinally at opposite ends in the space between opposed extrinsic portal-defining upright structures such as poles for supporting a service station canopy, and intended for display or advertising purposes.

In many kinds of businesses such as convenience stores, service stations, restaurants and other businesses typically of a drive-in type, a canopy, awning or other structure of the premises is supported by poles or columns. In these kinds of businesses, it is often desirable to be able to provide a display which spans the portal space between poles, such as for the purpose of identifying the nature of the business, advertising the services or merchandise offered, showing prices and presenting prominently other display or advertising material. In these instances utilizing an outdoor display, there are often very open spaces, such as the portals between the poles or other upright structures, through which the wind is free to blow without being resisted by nearby structures, so that any sort of display to be supported between such structures must be capable of being extraordinarily wind-resistant and thus to be capable of withstanding wind velocities of 100 or even 120 mph without bending or other damage. In providing a display suitable for extending over the distances, which may be substantial and of the order of even 10–20 ft or more, the bending movement recognizably becomes very substantial. Heretofore, this has required bracing or other reinforcement materials, typically of steel or other alloys to brace the panels of the display against being bent or otherwise deformed, much less destroyed because of the high wind velocity. Such spanning displays of the prior art have, therefore, typically been rather heavy, cumbersome and expensive as well as requiring the careful and time-consuming fitment and securement of the various structural components, securement to them of face panels, and mounting hardware which is time-intensive in application as well as costly. So-called "oil-canning" (i.e., undesirable flexing) of metal panels of prior art displays has also been a problem.

Accordingly, among the several objects of the invention may be noted the provision of an improved spanner type of display, and particularly one suitable for securement by attachment at opposite ends in a space between opposed extrinsic portal-defining upright structures such as poles and which is useful in the type of display application known as a two-pole spanner.

It is an object of the present invention to provide such a elongated spanner type display including a display member which is very light in weight but of such strength as to provide extraordinary resistance to wind forces, even when exposed to wind velocities of 100–120 mph, and in such application resists bending, deformation, distortion, vibration, and is also free from so-called "oil-canning."

It is further an object of the invention to provide such a display which is very simply and easily configurable into a precise length for being installed between poles or other upright structures regardless of the distance between them, being readily cut to length, it being also an object of the invention to provide such a display which can be installed in a remarkably facile way through the use of supporting members such as will enable an installer, such as even a relatively unskilled laborer, to quickly mount the display in place and easily position it in secured display configuration.

A further object of the invention is the provision of such a display which is of extreme simplicity, being conducive to low cost, economic manufacture and utilizing relatively inexpensive synthetic materials.

Briefly, a wind-resistant elongated spanner of the invention comprises a display member for being longitudinally supported at its opposite ends between the poles or other upright portal-defining structures in longitudinal display configuration, the display member having a thin beam configuration core presenting parallel, rectangular front and rear faces with a high aspect ratio. At the top and bottom core faces, channel configuration top and bottom rails are provided of metal, and metal face panels extend over the front and rear core faces. Layers of adhesive are interposed between the face panels and the respective front and rear core faces, such that the face panels are adhesively secured, but opposite end faces of the core remain uncovered. Channel-configuration mounting members are utilized for mounting of opposite ends of the display member, each mounting member being configured for attachment to a respective upright structure, such as a pole, and defining a channel opening toward the display member for reception of marginal portions thereof.

Other objects and features of the invention will be in part apparent and in part pointed out hereinbelow.

DESCRIPTION OF THE PREFERRED EMBODIMENT

Figure 1:
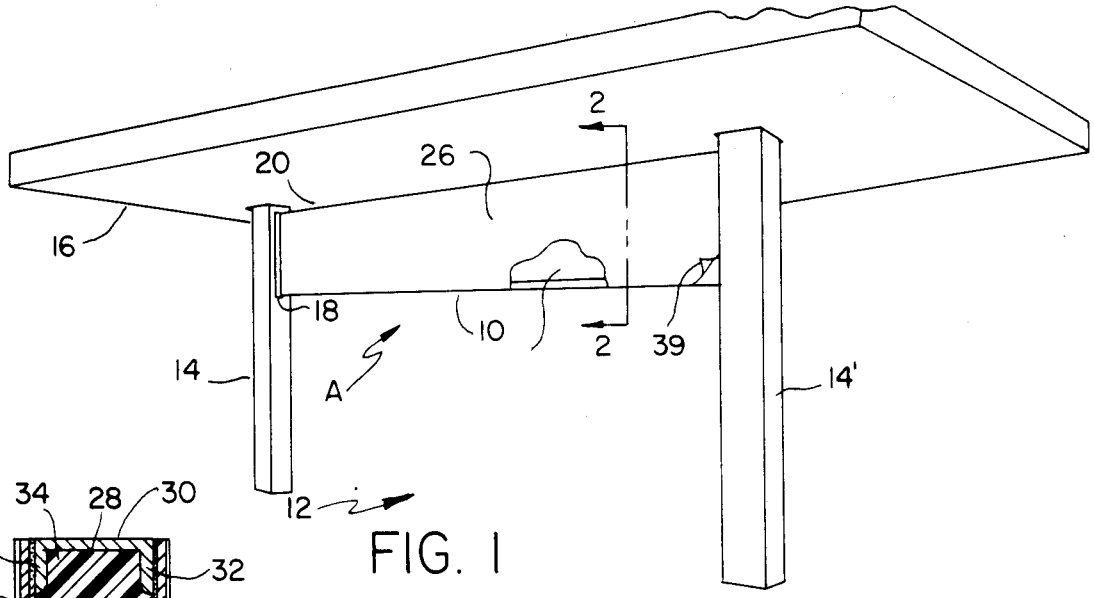
FIG. 1 is a perspective view of a spanner display in accordance with the present invention, as secured at opposite ends to two poles which support a canopy.

Referring now to the drawings illustrated generally at A is a wind resistant elongated spanner having a display member 10 supported longitudinally at its opposite ends in a space 12 between opposed poles 14, 14' which support a canopy 16 of the type found at service stations and other business establishments, such as restaurants of the drive-in type. This illustration is not intended to limit the use of the spanner display A according to the present invention, but is instead illustrative of the numerous types of businesses or the like where extrinsic upright structure provide a portal space between them for the presentation of material.

Display member 10 is supported at its opposite ends by brackets 18, 18' in horizontal display configuration with said member 10 proximate to canopy 16 but providing a space 20 between the upper edge of member 10 and the canopy undersurface for a reason set forth below.

Member 10 is formed of a thin beam configuration core 22 of lightweight porous material, such as most preferably expanded polystyrene (EPS) such as of a density, for example, of about 32 lb/ft$^3$, the same being very light, relatively high strength material in this instance. Such density is formed to provide a critical combination of sufficient strength and yet light weight.

An example of the core thickness for a display of the present configuration is slightly less than 2.5 in. Such thin, porous synthetic core 22 is of rectangular configuration in side elevation to present parallel, rectangular front and rear faces having a high aspect ratio, i.e., at least 2:1 such as, for example, being of a height of 2–3 ft and a length of at least twice that value typically and, more typically, extending over a span of 10–20 ft up to as much as 25 ft. In accordance with the invention, the display member 10 is of length configured to fit precisely within brackets 18, 18' and thus will be cut to fit for a specific installation depending upon the portal space available between the upright members, such as poles 14, 14'.

Figure 2:
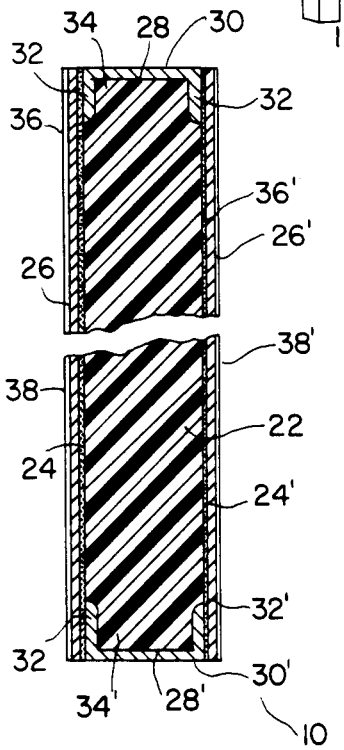
FIG. 2 a vertical cross-section as taken along line 2—2 of FIG. 1

Core 22 will thereby present front and rear core faces 24, 24' which are covered by respective face panels 26, 26'. The panels 26, 26' may be of a thickness of about 0.030 in. Top and bottom core faces 28, 28' are covered by top and bottom rails 30, 30' which are of rectangular configuration as shown in cross section in FIG. 2. Rails 30, 30' have accordingly side flanges as at 32 which extend inwardly of the core and which are covered by face panels 26, 26'. Core 22 is of thickness slightly greater than the channel interior width between the side flanges 32.

In manufacturing display 10, core 22 may be suitably notched along its top and bottom at its upper and lower edges to provide tongue-shaped portions 34, 34' for reception within the channels of the rails 28, 28'. With said rails in place being held, by example, by an assembly jig, layers 36, 36' of adhesive are applied to the front and rear faces 24, 24' of the core, and to the exposed outer surfaces of the flanges 32 of channels 30, 30' as depicted with exaggerated thickness in FIG. 2.

The commercially available adhesive is most preferably of a mist-activated type, such as the urethane prepolymer laminating adhesive sold under the trademark "MorAd 434" by Morton Thiokol, Inc., Morton Chemical Division, 333 W. Wacker Drive, Chicago, Ill. 60606, described additionally by the following physical data:

| | |
|---|---|
| % Non-volatiles: | 78 |
| Vapor Density (Air = 1): | 1 (heavier than air) |
| pH: | Not applicable |
| Boiling Point: | Approx. 104° F. (based on methylene chloride) |
| Vapor Pressure: | Approx. 380 mm @ 22° C. (based on methylene chloride) |
| Solubility in Water: | Insoluble |
| Specific Gravity ($H_2O$ = 1): | 1.15 |
| Evaporation Rate (nBUOAc = 1): | 1 |
| Appearance: | Thin liquid |
| Odor: | Solvent |

Said adhesive includes the following solvent ingredients and percentages:

| Chemical Name/Common Name | % |
|---|---|
| Methylene Chloride/ Dichloromethene | 5–10 |
| Free Methylene-Bisphonyl Isocyanate/M.D.I. | 5–10 |
| 1,1,1-Trichloroethane/ Methyl Chloroform | 10–5 |

Said data, of course, applies to this adhesive prior to application. The adhesive layers 36, 36' are applied by roller to the exposed core faces 24, 24' and to the top and bottom edges 28, 28'. A bead of the adhesive is also applied to the exterior surface of the flanges of channels 30, 30' along their length. The channels are then pressed in place on the core. The entire core assembly is then treated by exposure to water mist to activate the adhesive. Rectangular face panels 26, 26' are then positioned. Pressure of at least about 6–8 psi is then applied to face panels 26, 26' to slightly compress the core and bring the face panels into contact with the channel side flanges 32, and display member 10 is now complete. The overall length of member 10 may be standardized for an intended use but can be cut to a desired ultimate length for a specific installation location as depicted.

Channel members 30, 30' are most preferably formed of extruded aluminum or aluminum sheet material, having a typical base flange dimension of about 2.5 in, which said flanges 32 being of about 1.5 in. The channel material thickness may be typically about 0.125 in. Similarly, the face panels 26, 26' are most preferably of aluminum, but prior to being adhesively secured in place, may be most preferably provided with respective layers 38, 38' which may be paint or other laminated display surface treatments providing a desired display format. Thus the display configuration, advertising, legends, logos and other information may be advantageously applied to panels 26, 26' before the same are assembled into a completed display member 10. A protective layer 39 of peel-off type may cover each of layers 38, 38', to be stripped off after the unit is installed as shown in FIG. 1.

The completed display member will withstand wind velocities typically of up to 30 lb/ft$^2$ such that, installed in the manner shown in FIG. 1, the completed spanner display can withstand wind velocities of more than 100 mph, and typically of up to 120–130 mph, without sustaining damage.

Figure 3:
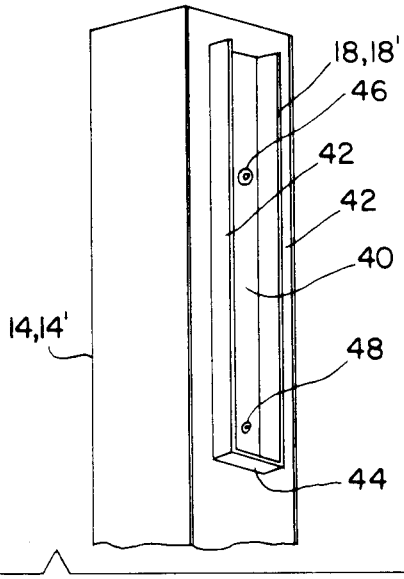
FIG. 3 is a prospective view of a bracket fixture of the invention for supporting an end of the display member shown in FIG. 1.

Referring to FIG. 3, the fixtures or mounting brackets 18, 18' have a rectangular cross-section with a base member 40 and side flanges as at 42 providing between them sufficient space within the rectangular recesses thus defined for receiving marginal end portions of display member 10 with a sliding fit. Each of said mounting brackets 18, 18' is provided with a lower flange 44 for closing the end of the channel thus provided and with sufficient strength for supporting at least half of the weight of member 10.

Figure 4:
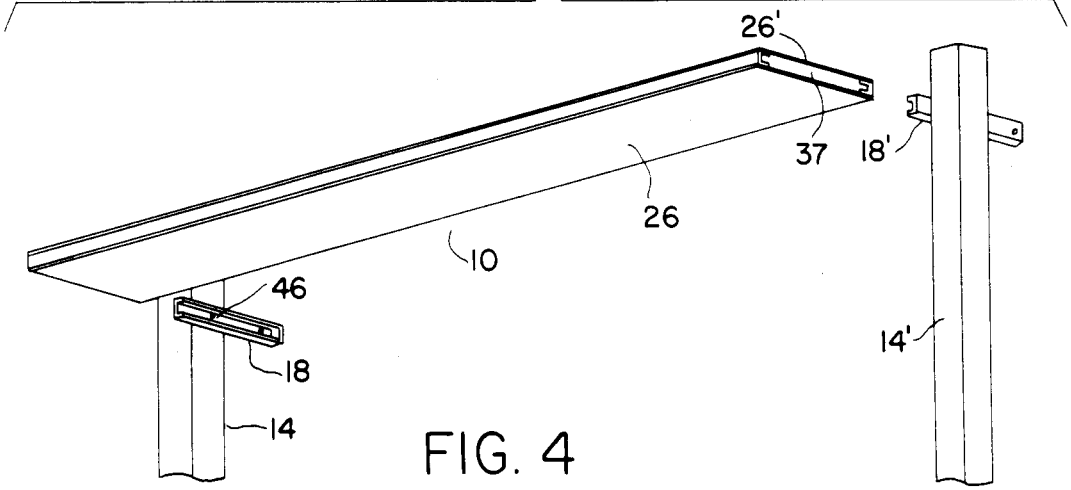
FIG. 4 is a perspective view illustrating the installment of the display of FIG. 1 by insertion of opposite ends of the display member into brackets according to FIG. 3 for ultimate rotation into the position shown in FIG. 1, prior to carrying out a last step of the installation to complete the display of FIG. 1.

Installation is carried out in the manner depicted in FIG. 4. In installing display member 10, it may be necessary to cut same to a desired length. A carbide-tipped circular saw can readily be used during field installation to saw the display member to a length sufficient for being received by brackets 18, 18'. The pole 14, 14' or other vertical support is drilled to provide for insertion of a drive rivet 46 as shown also in FIG. 3, and at a lower location also for receiving another drive rivet or other fastening means. Each bracket member 18, 18' is rotated into a horizontal position as shown in FIG. 4 and the opposite ends of member 10 are then inserted by sliding them into the channel of the bracket members. Bracket members 18, 18' are then rotated by pivoting about the drive rivet to position the display as shown in FIG. 1. The previously-exposed end faces of the core are now fully received within bracket members 18, 18'.

Each of the channels is provided with an aperture at a lower end as shown at 48 for receiving a drive rivet, screw or other fastening device to affix and secure the bracket in vertical position. When the display member 10 is in the vertical position shown in FIG. 1, display member 10 may be slid upwardly against the undersurface of canopy 16, thereby exposing the aperture 48 and permitting insertion of a drive rivet, for example. When display member 10 is then allowed to be seated on flange 44, space 20 remains between the upper edge of member 10 and the undersurface of canopy 16.

The protective film can now be stripped off of the completed unit as shown installed in FIG. 1.

In view of the foregoing, it will be seen that the several objects of the invention are achieved and other advantages are attained.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. For use in a wind-resistant elongated spanner, a display member for being supported longitudinally in display configuration, the display member comprising a thin beam configuration core of expanded polystrene presenting parallel, rectangular front and rear faces having a high aspect ratio, channel configuration top and bottom rails extending along top and bottom core faces, face panels of aluminum sheet material extending over the front and rear core faces, and layers of mist-activated laminating adhesive interposed between the face panels and respective front and rear core faces for securement of the face panels to the core, said laminating adhesive prior to application being a water-insoluble, thin liquid urethane propolymer solution having 78% non-volatiles, a vapor density greater than air, a boiling point of 104° F., based on methylene chloride), a vapor pressure of approximately 380 mm at 22° C., (based on methylene chloride), a specific gravity of 1.15, an evaporation rate (nBUOAc=1) of unity, and a solvent odor, opposite end faces of the core being uncovered, whereby the display member is sufficiently strong as to be wind-resistant when its opposite ends are supported by said upright structures.

2. For use in a wind-resistant elongated spanner according to claim 1, the core having a density of about 32 $lb/ft^3$.

3. For use in a wind-resistant elongated spanner according to claim 1, the channel members each being of aluminum and having a rectangular section including a base flange overlying the respective top and bottom core face, and side flanges, the face panels overlying the respective side flanges, the adhesive being interposed also between the side flanges and face panels.

4. For use in a wind-resistant elongated spanner according to claim 3, the core being notched along top and bottom edges thereof to provide tongue-shaped portions received by the channel members.

5. For use in a wind-resistant elongated spanner according to claim 1, further comprising mounting members of channel configuration defining recesses opening toward the display member for receiving marginal portions of a respective end thereof.

6. For use in a wind-resistant elongated spanner, a display member for being supported longitudinally at opposite ends in the space between opposed extrinsic portal-defining upright structures in display configuration, the display member comprising a thin beam configuration core presenting parallel, rectangular front and rear faces having a high aspect ratio, channel configuration top and bottom rails extending along top and bottom core faces, metal face panels extending over the front and rear core faces, layers of adhesive interposed between the face panels and respective front and rear core faces for securement of the face panels to the core, opposite end faces of the core being uncovered, whereby the display member is sufficiently strong as to be wind-resistant when its opposite ends are supported by said upright structures, and mounting members of channel configuration defining recesses opening toward the display member for receiving marginal portions of a respective end thereof, the mounting members each being apertured for securement to a respective upright structure by a first fastening device for permitting rotation of the mounting member by pivoting about said first fastening device for insertion into the recess of the respective end of the display member and apertured also for receiving a further fastening device following said insertion to affix and secure the mounting member in vertical position.

7. A wind-resistant elongated spanner comprising a display member for being supported longitudinally at opposite ends in the space between opposed extrinsic portal-defining upright structures in display configuration, the display member comprising a thin beam configuration core presenting parallel, rectangular front and rear faces having a high aspect ratio, channel configuration top and bottom rails extending along top and bottom core faces, metal face panels extending over the front and rear core faces, and layers of adhesive interposed between the face panels and respective front and rear core faces for securement of the face panels to the core, opposite end faces of the core being uncovered, and a pair of mounting members for mounting of opposite ends of the display member, each mounting member being configured for attachment to a respective upright structure and defining a channel opening toward the display member for reception of marginal portions of a respective end of the display member.

* * * * *